United States Patent [19]

Benedict

[11] Patent Number: 4,592,507

[45] Date of Patent: Jun. 3, 1986

[54] APPARATUS AND METHOD FOR PRODUCING AND UNIFORMLY APPLYING FOAMED BITUMINOUS BINDERS TO ROAD SURFACES

[76] Inventor: Charles R. Benedict, 320 Northview Rd., Dayton, Ohio 45419

[21] Appl. No.: 752,089

[22] Filed: Jul. 5, 1985

Related U.S. Application Data

[63] Continuation of Ser. No. 538,973, Oct. 5, 1983, abandoned.

[51] Int. Cl.[4] ..... E01C 19/16

[52] U.S. Cl. ..... 239/172; 239/417; 239/434.5; 239/551

[58] Field of Search ..... 239/159, 163, 172, 407, 239/416.5, 434.5, 550, 551, 597; 106/122; 427/138

[56] References Cited

U.S. PATENT DOCUMENTS

| | | | |
|---|---|---|---|
| 960,150 | 5/1910 | Binks | 239/597 |
| 1,660,557 | 2/1928 | Heimburger | 239/434.5 |
| 1,803,248 | 4/1931 | Hack | 239/159 |
| 2,861,787 | 11/1958 | Csanyi | 416/227 |
| 2,917,395 | 12/1959 | Csanyi | 106/122 |
| 3,086,713 | 4/1963 | Moldenhauer | 239/159 |
| 3,120,927 | 2/1964 | Holland | 239/159 |

*Primary Examiner*—Andres Kashnikow
*Attorney, Agent, or Firm*—Jacox & Meckstroth

[57] ABSTRACT

Apparatus and a method for coating a road surface with bitumen binder material. The apparatus includes distribution conduit members for conducting bitumen material in a fluid state from a continuous source thereof and distribution conduit members for conducting gas, preferably steam, from a continuous source thereof. A plurality of mixer housings are joined to the conduit members and receive bitumen binder material and gas. The apparatus is carried by a vehicle which travels over a road surface. The bitumen binder material and the gas are mixed and sprayed upon the road surface as the vehicle travels over the road surface.

5 Claims, 4 Drawing Figures

APPARATUS AND METHOD FOR PRODUCING AND UNIFORMLY APPLYING FOAMED BITUMINOUS BINDERS TO ROAD SURFACES

RELATED APPLICATION

This application is a continuation of application Ser. No. 538,973, filed Oct. 5, 1983, now abandoned.

BACKGROUND OF THE INVENTION

Liquified bituminous binders, such as tar, cutback asphalt, emulsified asphalt and the like are applied to road surfaces by various methods and by various types of equipment. Numerous problems are involved in the application of such materials to road surfaces. The bituminous binder must be liquified, thinned or fluidized to a viscosity which is suitable for producing an adequate smooth and uniform spray when a pressurized stream of the liquified binder is discharged from a spray nozzle.

Conventionally a bituminous binder is fluidized or reduced in viscosity by applying heat thereto, or by adding an evaporative solvent or thinner thereto, or by combining the bituminous binder with water and an emulsifying agent.

Adhesion of the bituminous binder to the road surface and to the cover stones is critical to the success of the application of the bituminous binder. Proper adhesion is primarily a function of the viscosity of the bituminous binder during the application process. Under normal circumstances the viscosity of the cutback binders and emulsion binders is adequate to provide good adhesion. However, when pure undiluted binders, such as penetration grade asphalt cements, are melted and liquified by heat and sprayed for sealing in a chip seal process, the pavement surfaces and road stones or aggregates must be warm, dry, and dust free. Such conditions are rareIy found in temperate climates during the construction season. Therefore, pure undiluted asphalt cements are not generally used, and cutback and emulsion materials are preferred.

Emulsion materials conventionally contain one-third water and two-thirds binder. A problem exists in that emulsion materials are generally intolerant to dusty aggregates. Emulsion materials are likely to be washed away by sudden rain showers which occur during application of the emulsion materials.

Solvent cutback binders (bitumens diluted with evaporative solvents) are relatively expensive but are more tolerant of dusty aggregates than emulsion binders. Solvent cutback binders become objectionably messy when exposed to wet road stones or sudden rain showers. Solvent cutback binders require long periods of time to cure as the solvents evaporate. Evaporation of the solvents pollutes the environment.

When pure 100% bituminous binders are used, substantial economy, plus other advantages, are realized.

U.S. Pat. Nos. 2,861,787 and 2,917,395 relate to the process of producing foamed bituminous binders. These patents disclose the mixing of a gas or steam with bitumens which are heated. The mixture is directed through restricted orifices of a foam generating nozzle. The quality of the foamed binder is varied from a multiplicity of finely divided bubbles (a discrete foam) to a coarse "congealed" foam. This variation is accomplished by changing the temperature and pressures of the binder and the gas or steam. The quality of the foamed binder is also variable by changing the geometry and dimensions of the restricted orifices and by changing the gap between a foam generation throat and the internal foam gas injection nozzle.

These patents recognize that the properties of foamed bituminous binders are vastly different from the properties of a liquid binder, in that the foamed bituminous binder is rubbery, extremely sticky, highly cohesive and adhesive. Also, the foamed bituminous binder consists of thin films which have a high degree of natural surface tension and energy forces which are available to coat aggregate surfaces. Also, the foamed bituminous binders penetrate small voids, crevices and agglomerations of duct. Foamed bituminous binders can be applied at relatively low temperatures and in the presence of water.

All of these properties of a foamed bituminous binder combine with the economy available in the use of an undiluted bituminous binder. Thus, the use of a foamed bituminous binder is especially desirable for spraying road surfaces. However, the apparatus and methods disclosed in these patents are only used in stationary mixing situations and are not used for spraying road surfaces.

It is an object of this invention to provide apparatus and a method for producing a controlled foamed bituminous binder and for uniformly applying 100% bituminous binders to road surfaces.

The physical properties of bituminous binders (viscosity-temperature relationships, surface tension, adhesion, and rheological behavior) vary widely, in accordance with such factors as their natural physical properties, crude production methods, methods of refining. Therefore, the foam forming characteristics of each bituminous binder varies widely. It is therefore another object of this invention to provide foam forming apparatus which is easily and readily adjusted to produce a foamed bituminous binder of proper characteristics regardless of the physical properties of the bituminous binder.

Other objects and advantages of this invention reside in the construction of parts, the combination thereof, the method of production and the mode of operation, as will become more apparent from the following description.

SUMMARY OF THE INVENTION

The apparatus of this invention comprises means for uniformly applying bituminous binders to road surfaces. The invention includes means for introducing a gas, such as steam, into the bituminous binder material as the binder material in a fluid state flows toward a road surface. The gas is mixed with a bituminous binder material to form a foam which is sprayed upon the road surface.

DETAILED DESCRIPTION OF THE INVENTION

Figure 1:
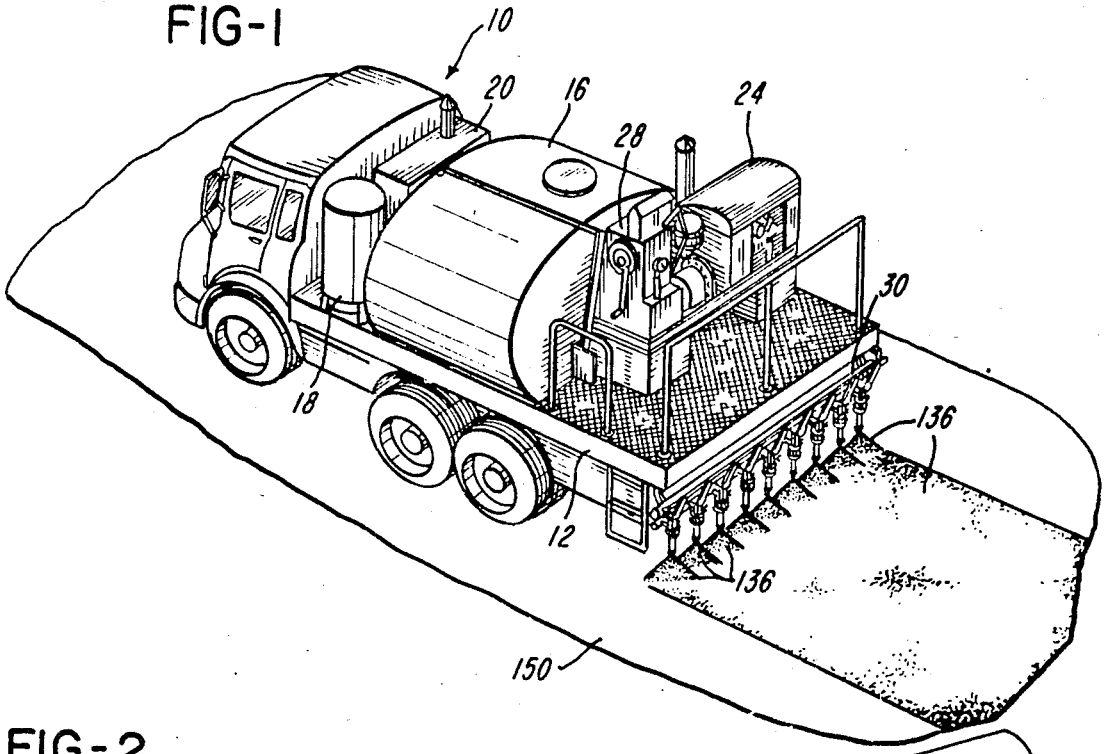
FIG. 1 is a perspective view of apparatus of this invention for producing and uniformly applying foamed bituminous binders to road surfaces.

The apparatus shown in FIG. 1 comprises a truck 10, provided with a support bed 12. Mounted upon the support bed 12 is a tank 16, which is adapted to contain bitumen binder material. Means, not shown, is employed to heat the tank 16 and the material therein. Also mounted upon the bed 12 is a tank 18 adapted to contain water and a boiler or steam generator 20 for heating water which flows from the tank 18, for producing steam. Also mounted upon the bed 12 is an engine 24 and a pump 28 operated thereby.

Extending across the rear portion of the truck 10 below the bed 12 is a distributor conduit 30, shown in FIGS. 2 and 3. The distributor conduit 30 is connected to a main line 34 which is connected in a manner not shown to the pump 28. Also extending across the rear portion of the truck 10 below the bed 12 is a distributor conduit 40, shown in FIGS. 2 and 3, which is connected to the boiler 20.

Attached to the distributor conduit 30 and extending therefrom are a plurality of spaced-apart relatively short connector pipes 46. Joined to each connector pipe 46 is a valve housing 48 provided with a valve 50 therein. Each valve 50 has a valve stem 54 attached to a handle 58. Each valve housing 48 has an outlet portion 48*a*.

Attached to the distributor conduit 40 are a plurality of spaced-apart short pipes 66, each of which has an adapter pipe 68 attached thereto. Each adapter pipe 68 is attached to a mixer housing 70. The upper portion of each mixer housing 70 is attached to the outlet portion 48*a* of a valve housing 48. Within the upper part of each mixer housing 70 and within the respective valve housing 48 is a flow restrictor 72 provided with an orifice 74.

Each mixer housing 70 has a transverse tube 76 therein which is joined to its respective adapter pipe 68. The transverse tube 76 within each mixer housing 70 has joined thereto a longitudinal tube 80, which extends from the transverse tube 76. The lower part of each mixer housing 70 is provided with a threaded portion 84 to which is threadedly attached a director cap 88. Within each director cap 88 is a throat member 90 provided with a passage 92 therethrough. The throat member 90 has a conical upper surface 93, which encompasses the lower portion of its respective longitudinal tube 80. Attached to the lower portion of each director cap 88 is a nozzle 94 provided with a slot shape opening 96 at the lower portion thereof, as shown in FIGS. 3 and 4.

Attached to the exterior surface of each mixer housing 70 is a resilient strip 97. Around the exterior of each director cap 88 is a series of vertical slots 99. The respective resilient strip 97 is positionable within one of the slots 99 to secure the rotative position of the director cap 88 with respect to the mixer housing 70 to which the director cap 88 is attached. A threaded stud 100 extends through each resilient strip 97 and is attached to the respective mixer housing 70. A wing nut 102 is threadedly attached to each stud 100 and is engageable with the respective resilient strip 97 to retain the resilient strip 97 in one of the slots 99.

Figure 2:
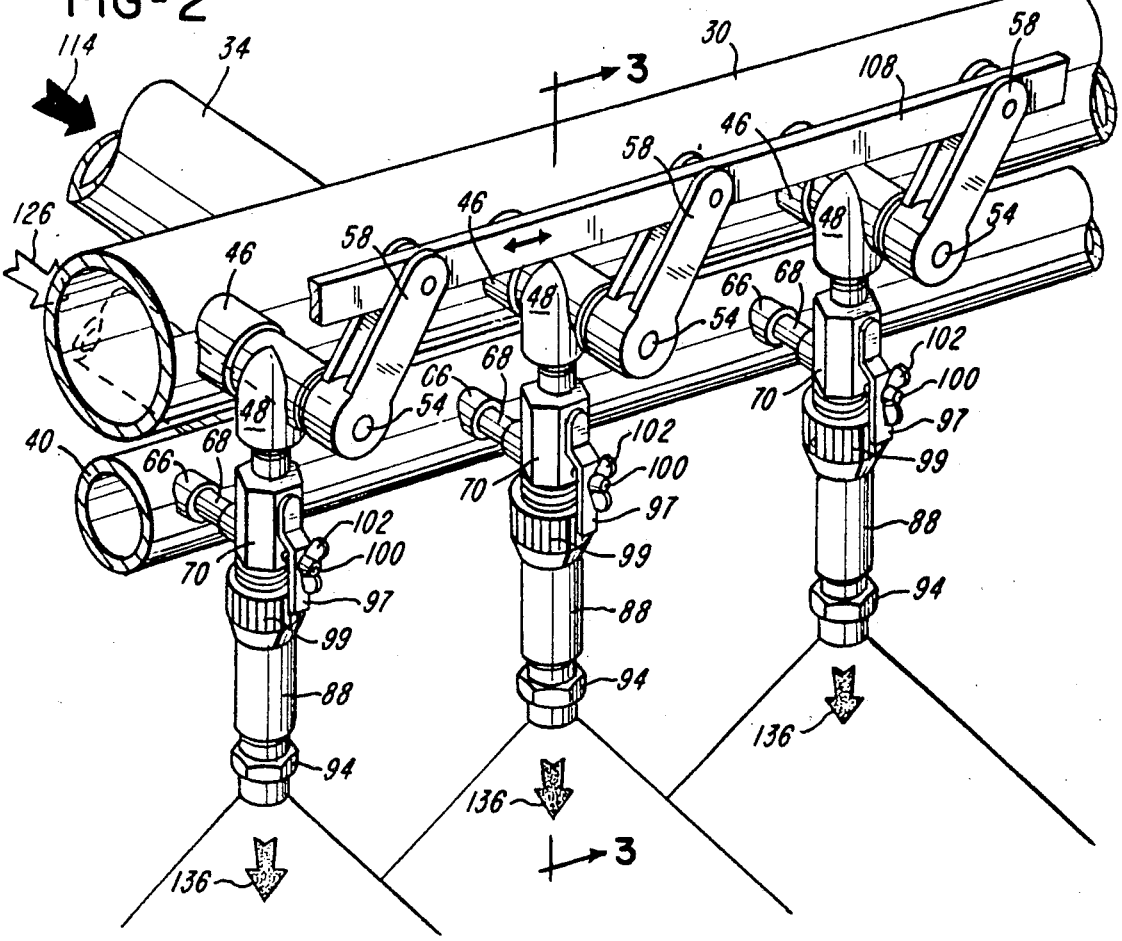
FIG. 2 is a greatly enlarged perspective view of a portion of the apparatus of FIG. 1.
Figures 3, 4:
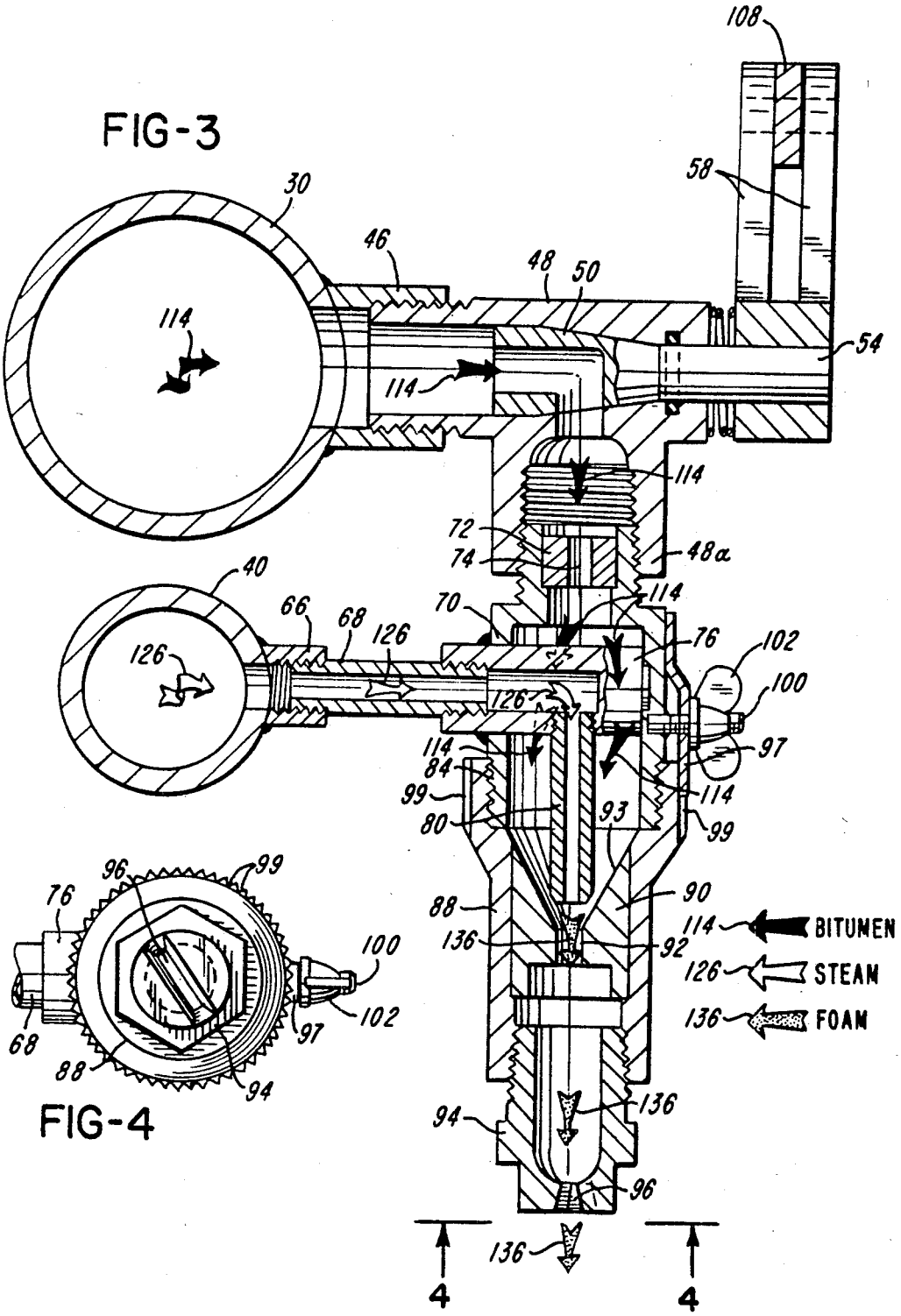
FIG. 3 is an enlarged sectional view taken substantially on line 3—3 of FIG. 2.
FIG. 4 is a sectional view taken substantially on line 4—4 of FIG. 3.

As shown in FIG. 2, the handles 58 of the valve stems 54 are joined together with a connector bar 108.

Operation

Heated bitumen, illustrated by arrows 114, flowing from the tank 16 is forced by the pump 28 into the distributor conduit 30. The bitumen 114 flows from the distributor conduit 30 into the short connector pipes 46, then into the respective valve housing 48 and through the valve 50 thereof. The flow of the bitumen 114 is restricted by the orifice 74 in the restrictor 72. Thus, the orifice 74 is restrictive and is always completely filled with bitumen 114 flowing therethrough. The bitumen 114 flows from the restrictor 72 into the mixer housing 70. The bitumen 114 flows around the transverse tube 76 and along and around the longitudinal tube 80. The bitumen 114 then is directed by the conical surface 93 into the passage 92. However, prior to flow of the bitumen 114 into the passage 92, the bitumen 114 is engaged by steam 126 which flows from the steam generator 20 into the conduit 40, through the adapter pipe 68 and into the transverse tube 76. The steam 126 then flows through the longitudinal tube 80 and engages the bitumen 114 adjacent the conical surface 93 of the throat member 90. In this region the steam 126 mixes with the bitumen 114 and a foam 136 is formed and flows through the passage 92 to the nozzle 94. The foam 136 then flows through the nozzle 94 and outwardly through the slot 96 thereof.

The nozzles 94, as illustrated in FIG. 2 are rotatively positioned so that the slot shape opening 96 therein directs the foam 136 in a flow pattern which does not interfere with the flow pattern of the adjacent nozzle 94. Thus, as illustrated in FIG. 1 a road surface 150 is coated with the foam 136. Thus, the advantages of coating a road surface with a foam as discussed above are obtained.

The characteristics of the foam 136 depend upon the length and area of the passage 92. The characteristics of the foam 136 also depend upon the spacing between the longitudinal tube 80 and the conical surface 93. The spacing between the tube 80 and the conical surface 93 is adjustable by rotative movement of the director cap 88 with respect to the mixer housing 70. Such rotative movement of the mixer housing 70 is accomplished by first loosening the wing nut 102, permitting the resilient strip 97 to be positioned within another slot 99 as the mixer housing 70 is rotated.

The restrictor 72 and the throat member 90 are easily and readily removable and replaceable as desired.

All of the valves 50 are simultaneously adjustable by longitudinal movement of the connector bar 108 to control the volume of flow of the bitumen 114 into the mixer housing 70.

Although the preferred embodiment of the apparatus and method for producing and applying foamed bituminous binders according to this invention has been described, it will be understood that within the purview of this invention various changes may be made in the form, details, proportion and arrangement of parts, the combination thereof, and the mode of operation, which generally stated consist in the apparatus and method within the scope of the appended claims.

The invention having thus been described, the following is claimed:

1. Apparatus for coating a road surface with 100% bituminous binder material, the apparatus being of the type which includes a vehicle which travels over the road surface and in which a source of bituminous binder material in a fluid state is carried by the vehicle and in which a source of pressurized gas is carried by the vehicle, the vehicle having a forwardly and rearwardly extending longitudinal axis, the improvement comprising:

a first substantially horizontal fluid conduit carried by the vehicle, the first horizontal fluid conduit being transverse to the longitudinal axis of the vehicle and being positioned in spaced relationship above the road surface, a second substantially horizontal fluid conduit carried by the vehicle, the second horizontal fluid conduit being transverse to the longitudinal axis of the vehicle and being positioned in spaced relationship above the road surface, means joining the first fluid conduit to the source of bituminous binder material for fluid flow from the source of bituminous binder material to the first fluid conduit, means joining the second fluid conduit to the source of pressurized gas for fluid flow from the source of pressuried gas to the second fluid conduit, a plurality of mixer housings positioned adjacent the road surface, Docket 268 a plurality of first fluid connector members, there being one first fluid connector member joining each of the mixer housings to the first fluid conduit for fluid flow between the first fluid conduit and the respective mixer housing, a plurality of second fluid connector members, there being one second fluid connector member joining each mixer housing to the second fluid conduit for fluid flow between the respective mixer housing and the second fluid conduit, a plurality of director caps, each director cap having an upper part and a lower part, the upper part of each director cap being adjustably attached to one of the mixer housings in communication therewith as the director cap extends from the mixer housing, each director cap being provided with a throat portion having a downwardly directed outlet passage with gradually decreasing dimensions, a plurality of tubes, there being a tube fixedly positioned within each mixer housing and extending into the director cap which is adjustably attached thereto, the tube having an end portion within the throat portion of the director cap which is adjustably attached to the respective mixer housing, each tube being connected to the respective second fluid connector member for fluid flow from the second connector member and to the tube, a plurality of nozzle members, there being one nozzle member adjustably attached to each director cap and at the lower part of each director cap, each nozzle member having a discharge opening which is directed downwardly and in alignment with the outlet passage of the throat portion of its respective director cap, a plurality of securing members, there being one securing member attached to each mixer housing and engageable with the director cap which is adjustably attached to the mixer housing, each securing member being engageable with its respective director cap to retain the respective director cap in the adjusted position thereof with respect to the mixer housing, wherein bituminous binder material flows into the mixer housing from the first fluid conduit and wherein pressurized gas flows into the mixer housing from the second fluid conduit, the bituminous material and the gas being mixed within the mixer housing to form a foam, the foam flowing downwardly through the throat portion of the director cap and through the nozzle member and to the road surface, the director cap being adjustable with respect to the mixer housing to adjust the position of the throat portion of the director cap with respect to the tube to adjust the characteristics of foam flowing from the nozzle member.

2. The apparatus of claim 1 in which each nozzle member is threadedly adjustably attached to its respective director cap.

3. The apparatus of claim 1 in which each director cap is threadedly attached to its respective mixer housing, and in which each director cap has an exterior surface which is provided with a plurality of substantially vertical slots, and in which the securing member which is attached to each mixer housing comprises a resilient member which has a part thereof positionable within one of the slots of the director cap which is threadedly attached thereto, to maintain the adjusted position of the director cap with respect to the mixer housing.

4. The apparatus of claim 1 in which each nozzle member is rotatably adjustable about a vertical axis and in which the discharge opening in each nozzle member is elongate and transverse to the direction of flow of fluid therethrough so that adjustment of the nozzle member changes the angle of discharge of fluid from the nozzle with respect to the direction of travel of the vehicle.

5. The apparatus of claim 1 which includes a plurality of valve members, there being a valve member within each of the first fluid connector members and adjustable to control flow of fluid through the first fluid connector member, the apparatus also including means joining the valve members together for simultaneous operation thereof.

* * * * *

UNITED STATES PATENT AND TRADEMARK OFFICE

CERTIFICATE OF CORRECTION

PATENT NO. : 4,592,507

DATED : June 3, 1986

INVENTOR(S) : Charles Robert Benedict

It is certified that error appears in the above–identified patent and that said Letters Patent are hereby corrected as shown below:

Column 5, line 23, delete "Docket 268".

Signed and Sealed this

*Nineteenth* Day of *August 1986*

[SEAL]

*Attest:*

DONALD J. QUIGG

*Attesting Officer*

*Commissioner of Patents and Trademarks*